US009257805B2

(12) United States Patent
Wang

(10) Patent No.: US 9,257,805 B2
(45) Date of Patent: Feb. 9, 2016

(54) ROTATABLE FRAME, CONNECTOR, AND CONNECTOR SUPPORT SYSTEM

(71) Applicant: EMCOM TECHNOLOGY INC., Taipei (TW)

(72) Inventor: Chu-Li Wang, Taipei (TW)

(73) Assignee: EMCOM TECHNOLOGY INC., Taipei (TW)

( * ) Notice: Subject to any disclaimer, the term of this patent is extended or adjusted under 35 U.S.C. 154(b) by 109 days.

(21) Appl. No.: 14/070,525

(22) Filed: Nov. 2, 2013

(65) Prior Publication Data

US 2015/0011119 A1 Jan. 8, 2015

(30) Foreign Application Priority Data

Jul. 5, 2013 (CN) ..... 2013 1 0280703

(51) Int. Cl.

| | |
|---|---|
| ***H01R 13/60*** | (2006.01) |
| ***H01R 35/00*** | (2006.01) |
| ***H01R 13/447*** | (2006.01) |
| ***H01R 13/74*** | (2006.01) |
| *H01R 24/64* | (2011.01) |

(52) U.S. Cl.

CPC ..... *H01R 35/00* (2013.01); *H01R 13/447* (2013.01); *H01R 13/743* (2013.01); *H01R 24/64* (2013.01)

(58) Field of Classification Search

CPC ..... H01R 13/518; H01R 23/025

USPC ..... 439/534, 540.1, 676

See application file for complete search history.

(56) References Cited

U.S. PATENT DOCUMENTS

| | | | | |
|---|---|---|---|---|
| 5,639,261 | A * | 6/1997 | Rutkowski et al. | 439/534 |
| 6,537,106 | B1 * | 3/2003 | Follingstad | 439/534 |
| 6,916,199 | B2 * | 7/2005 | Follingstad | 439/534 |
| 7,112,090 | B2 * | 9/2006 | Caveney et al. | 439/540.1 |
| 7,179,119 | B2 * | 2/2007 | Follingstad | 439/534 |
| 7,335,056 | B1 * | 2/2008 | Clark et al. | 439/540.1 |
| 7,901,236 | B2 * | 3/2011 | Patchett | 439/354 |
| 8,834,199 | B2 * | 9/2014 | Foung et al. | 439/540.1 |

* cited by examiner

*Primary Examiner* — Thanh Tam Le

(74) *Attorney, Agent, or Firm* — Cheng-Ju Chiang

(57) ABSTRACT

A rotatable frame is provided for accommodating a connector. The rotatable frame can be used with a plate and includes a frame body, two positioning portions, and two pivots. The frame body has a first sidewall, a second sidewall, a top plate, and a bottom plate, wherein the first sidewall, the second sidewall, the top plate, and the bottom plate are connected to enclose an accommodation space for accommodating the connector and to form a connector inserting opening. The two positioning portions are respectively formed on the top plate and the bottom plate at one side that is near the connector inserting port. The two positioning portions respectively have a blocking surface, wherein the blocking surface obliquely extends away from the connector inserting opening. The two pivots respectively protrude from the outer side of the first sidewall and the outer side of the second sidewall coaxially.

23 Claims, 21 Drawing Sheets

ROTATABLE FRAME, CONNECTOR, AND CONNECTOR SUPPORT SYSTEM

BACKGROUND OF THE INVENTION

1. Field of the Invention

The present invention generally relates to a rotatable frame, a connector, and a connector support system; particularly, the present invention relates to a rotatable frame, a connector, and a connector support system which can adjust the wiring orientation of the connector to an oblique orientation.

2. Description of the Prior Art

When the conventional connector is arranged on a plate, the connector is inserted into the plate in a forward direction, and the wiring orientation at the connection between the connector and the wire is generally vertical to the rear surface of the plate. In practical applications, once the connection is impacted by a lateral force, the wire will easily come off from the connector, resulting in disconnection of the connector and the wire.

Moreover, in some cases, the plate is disposed on a wall, a machine cabinet and has a narrow gap from the environment therebehind. The types of the plate include, but are limited to, a faceplate or a wire board. However, the wires are easily bent due to the hindrance of the surrounding environment. In general, not only the service life of the wires but also the velocity and quality of transmission may easily decrease after the wires are bent for a long period of time.

Hence, there are attempts on improvement of the connector structure, so that the connector is rotatable to avoid damages to the wires. However, the connector having the rotatable function cannot be appropriately fixed on the plate, causing the connector easily swaying on the plate and degrading the stability.

SUMMARY OF THE INVENTION

In view of prior arts, the present invention provides a rotatable frame, a connector, and a connector support system which can rotate the connector and provide a multi-angled connection.

It is an object of the present invention to provide a rotatable frame to rotate the connector.

It is an object of the present invention to provide a rotatable frame having a positioning portion to maintain the rotating orientation of the connector.

It is an object of the present invention to provide a connector having the rotatable function to simplify the structure.

It is an object of the present invention to provide a connector support system, which includes the rotatable frame and a plate to realize the rotatable effect.

The present invention provides a rotatable frame used with a plate for accommodating a connector. The rotatable frame includes a frame body, two positioning portions, and two pivots. The frame body has a first sidewall, a second sidewall, a top plate, and a bottom plate, wherein the first sidewall, the second sidewall, the top plate, and the bottom plate are connected to enclose an accommodation space for accommodating the connector and to form a connector inserting opening.

The two positioning portions are respectively formed on the top plate and the bottom plate at a first side near the connector inserting opening. The two positioning portions respectively have a blocking surface, wherein the blocking surface obliquely extends away from the connector inserting opening. The two pivots respectively protrude from the outer side of the first sidewall and the second sidewall coaxially.

The present invention provides a connector used on a plate. The connector includes a connector body, a frame body, two positioning portions, and two pivots. The frame body has a first sidewall, a second sidewall, a top plate, and a bottom plate, wherein the first sidewall, the second sidewall, the top plate, and the bottom plate are connected to enclose an accommodation space for accommodating the connector body and to form a connector inserting opening. The two positioning portions respectively are formed on the top plate and the bottom plate at a first side near the connector inserting opening. The two positioning portions respectively have a blocking surface, wherein the blocking surface obliquely extends away from the connector inserting opening. The two pivots respectively protrude from the outer side of the first sidewall and the second sidewall coaxially.

The present invention provides a connector support system for accommodating a connector; the connector support system includes a plate and a rotatable frame. The types of the plate include, but not limit to, a faceplate and a wiring board. The plate has an outer surface, an inner surface opposite to the outer surface, and at least one ear part, wherein the at least one ear part extends vertical to the inner surface. The rotatable frame includes a frame body having a first sidewall, a second sidewall, a top plate, and a bottom plate, wherein the first sidewall, the second sidewall, the top plate, and the bottom plate are connected to enclose an accommodation space for accommodating the connector and to form a connector inserting opening. The two positioning portions are respectively formed on the top plate and the bottom plate at a first side near the connector inserting opening. The two positioning portions respectively have a blocking surface, wherein the blocking surface obliquely extends away from the connector inserting opening and selectively presses against the outer surface. The two pivots respectively protrude from the outer side of the first sidewall and the second sidewall coaxially and extend into the at least one ear part, so that the rotatable frame can rotate about the two pivots with respect to the plate.

The present invention provides a connector support system used for accommodating a connector; the connector support system includes a plate and a rotatable frame. The types of the plate include, but not limit to, a faceplate and a wiring board. The plate has an outer surface, an inner surface opposite to the outer surface. The plate also includes a first ear part, a second ear part, and two pivots, wherein the first ear part and the second ear part respectively extend vertical to the inner surface. The two pivots respectively protrude from the first ear part and the second ear part coaxially. The rotatable frame includes a frame body and a two positioning portions. The frame body has a first sidewall, a second sidewall, a top plate, and a bottom plate, wherein the first sidewall, the second sidewall, the top plate, and the bottom plate are connected to enclose an accommodation space for accommodating the connector and to form a connector inserting opening. The first sidewall and the second sidewall respectively have a first axle hole and a second axle hole. The two pivots are respectively inserted into the first axle hole and the second axle hole, so that the rotatable frame can rotate about the two pivots with respect to the plate. The two positioning portions are respectively formed on the top plate and the bottom plate at one side that is near the connector inserting opening. The two positioning portions respectively have a blocking surface, wherein the blocking surface obliquely extends away from the connector inserting opening and selectively presses against the outer surface.

Compared to prior arts, the rotatable frame of the present invention engages the connector on the frame body and utilizes the pivot to rotate the connector while the blocking surface of the positioning portion presses against the plate so as to fix the rotated connector on the plate. In practical applications, the present invention further provides a connector which has the rotating function and can be directly disposed on the plate. It is noted that, according to another embodiment of the present invention, the plate of the connector support system has an ear part, and the rotatable frame can be rotatably connected with the ear part so as to rotate the connector.

DETAILED DESCRIPTION OF THE PREFERRED EMBODIMENT

According to one embodiment of the present invention, a rotatable frame for a connector is provided. The rotatable frame can be used with a plate and accommodates the connector. In this embodiment, the rotatable frame can rotate on the plate to adjust the wiring orientation of the connector.

Figure 1A:
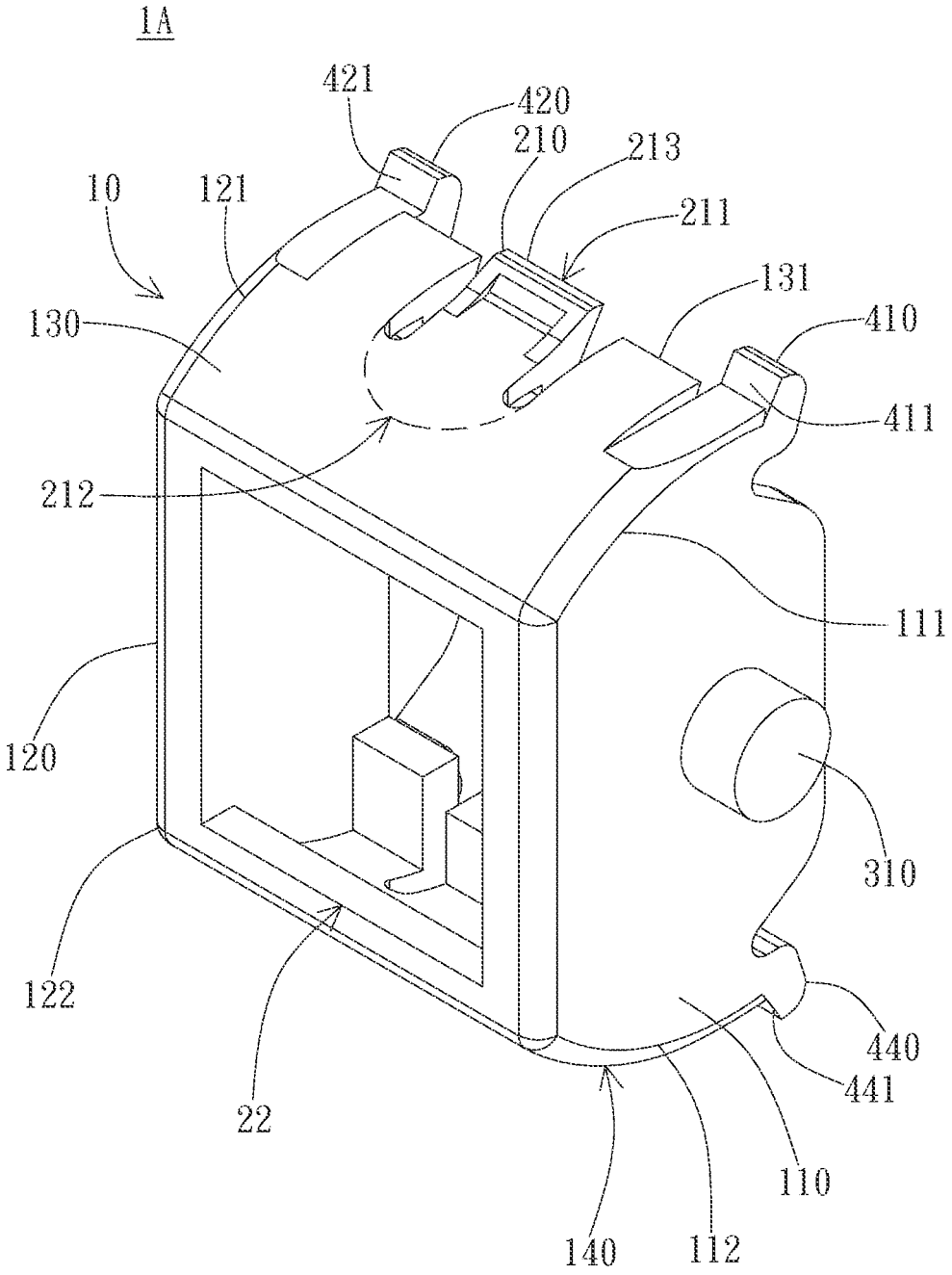
FIG. 1A is a schematic view of an embodiment of a rotatable frame of the present invention.
Figure 1B:
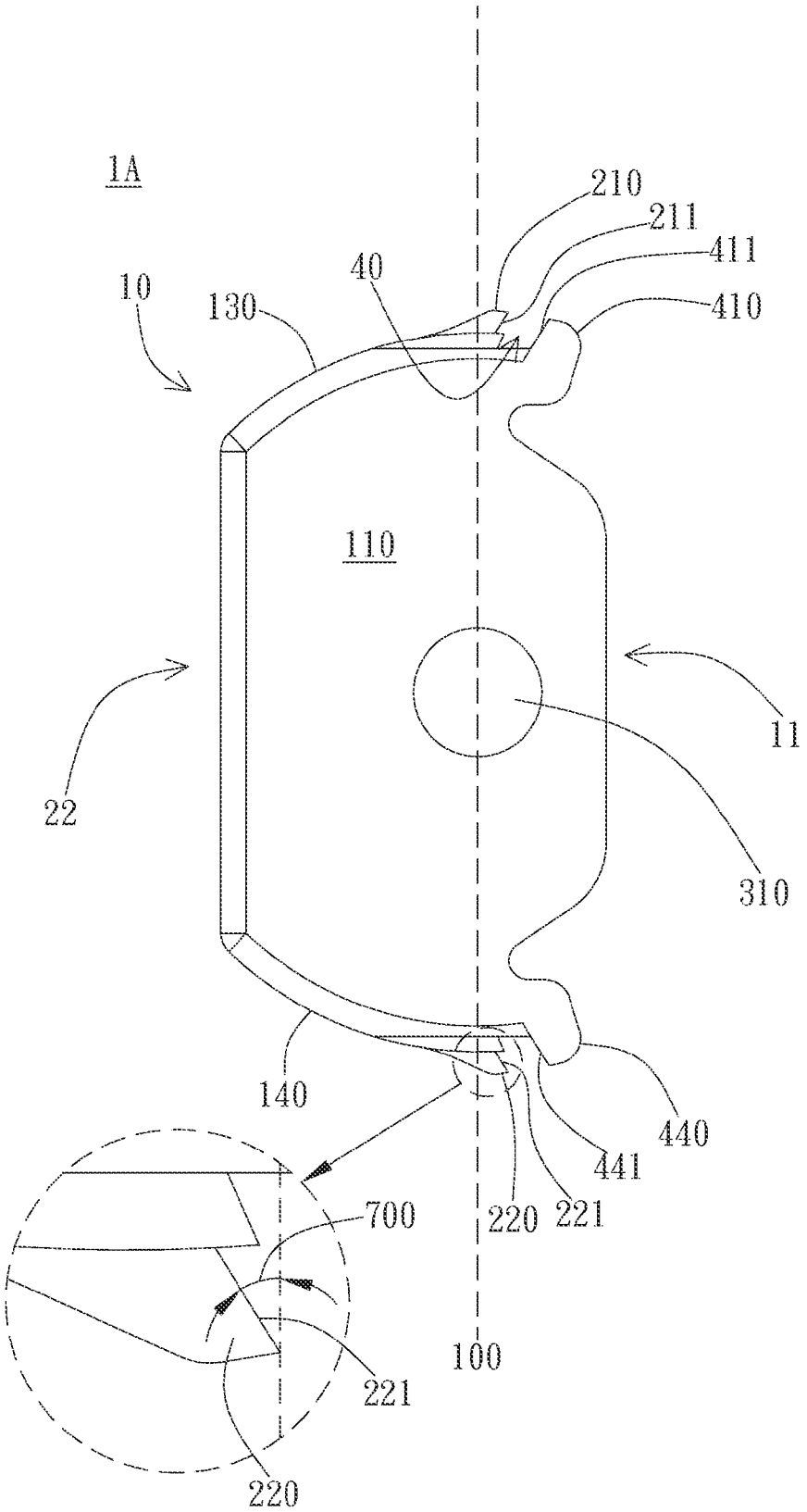
FIG. 1B is a side view of the embodiment of the rotatable frame of the present invention.
Figure 1C:
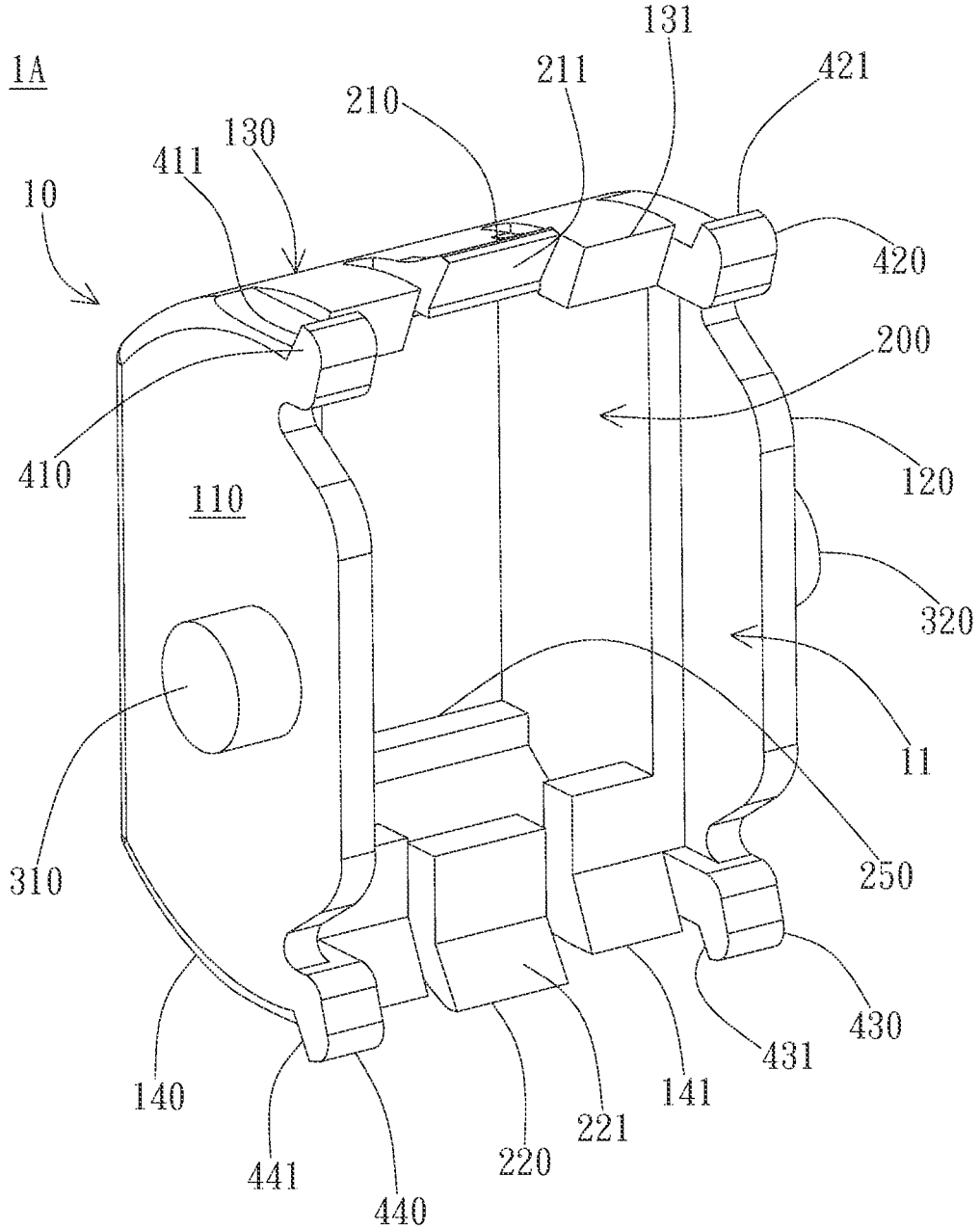
FIG. 1C is a schematic view of the embodiment of the rotatable frame of the present invention.

Please refer to FIGS. 1A, 1B, and 1C; FIG. 1A is a schematic view of an embodiment of a rotatable frame of the present invention; FIG. 1B is a side view of the embodiment of the rotatable frame of the present invention; and FIG. 1C is a schematic view of the embodiment of the rotatable frame of the present invention. As shown in FIGS. 1A through 1C, the rotatable frame 1A includes a frame body 10, two positioning portions 210/220, and two pivots 310/320. In the embodiment, the frame body 10 has a first sidewall 110, a second sidewall 120, a top plate 130, and a bottom plate 140, wherein the first sidewall 110, the second sidewall 120, the top plate 130, and the bottom plate 140 are connected to enclose an accommodation space 200 for accommodating a connector and to form a connector inserting opening 11. In practical applications, the connector is inserted into the connector inserting opening 11 and fixed on the rotatable frame 1A.

In addition, as shown in FIG. 1C, the two positioning portions 210/220 are respectively formed on the top plate 130 and the bottom plate 140 at first sides 131/141 near the connector inserting opening 11. The two positioning portions 210/220 respectively have blocking surfaces 211/221, wherein the blocking surfaces 211/221 obliquely extend away from the connector inserting opening 11. In practical applications, the two pivots 310/320 respectively protrude from the outer side of the first sidewall 110 and the second sidewall 120 coaxially. In other words, the pivot points of the pivots 310/320 are located on the same axis. In addition, as shown in FIG. 1B, the pivot point of the pivot 310 is located on a virtual plane 100 including the two positioning portions 210/220. It is noted that, as shown in FIG. 1B, an angle 700 is included between the blocking surface 221 and a surface parallel to the virtual plane 100, wherein the angle 700 is related to the rotating orientation of the rotatable frame 1A that is positioned on a plate. In practical applications, the angle 700 is between 10 degrees to 60 degrees, but not limited to the embodiment. In the embodiment, the angle is 30 degrees.

In the embodiment, as shown in FIG. 1C, the first sidewall 110 and the second sidewall 120 respectively include at least one protruding fingers 410/420/430/440, wherein the protruding fingers 410/440 and the protruding fingers 420/430 respectively extend from edges of the first sidewall 110 and the second sidewall 120 near the connector inserting opening 11 and crook to form an engaging surface. As shown in FIGS. 1A through 1C, the protruding finger 410 has an engaging surface 411; the protruding finger 420 has an engaging surface 421; the protruding finger 430 has an engaging surface 431; the protruding finger 440 has an engaging surface 441. For instance, the engaging surface 411 is parallel to the blocking surface 211 and has a clamping gap 40 with the blocking surface 211.

It is noted that, as shown in FIG. 1A, the top plate 130 and the bottom plate 140 are respectively a U-shaped plate; the two positioning portions 210/220 respectively extend from a recession of the U-shaped plate toward an opening of the U-shaped plate and respectively have a connecting end 212 and a free end 213. For instance, the connecting end 212 of the positioning portion 210 is connected to the top plate 130, and the connecting end of the positioning portion 220 is connected to the bottom plate 140; the free end 213 expands to form the blocking surface 211.

It is noted that the rotatable frame 1A is rotated about the pivots 310/320 and regards the sides of the first sidewall 110 and the second sidewall 120 connected to the bottom plate 140 and the top plate 130 as rotating curves. For instance, as shown in FIG. 1A, the sides 112/111 of the first sidewall 110 connected to the bottom plate 140 and the top plate 130 have a curved shape; the sides 122/121 of the second sidewall 120 connected to the bottom plate 140 and the top plate 130 also have a curved shape, and the top plate 130 and the bottom plate 140 curvedly connect the first sidewall 110 and the second sidewall 120. In addition, as shown in FIGS. 1A through 1C, the accommodation space 200 has an opening 22 opposite to the connector inserting opening 11, wherein the area of the opening 22 is less than the area of the connector inserting opening 11. That is, the opening 22 is smaller than the connector inserting opening 11. As shown in FIG. 1C, a frame border 250 is formed from the bottom plate 140 toward the opening 22, wherein the frame border 250 can block the connector from moving out of the opening 22.

Figure 2A:
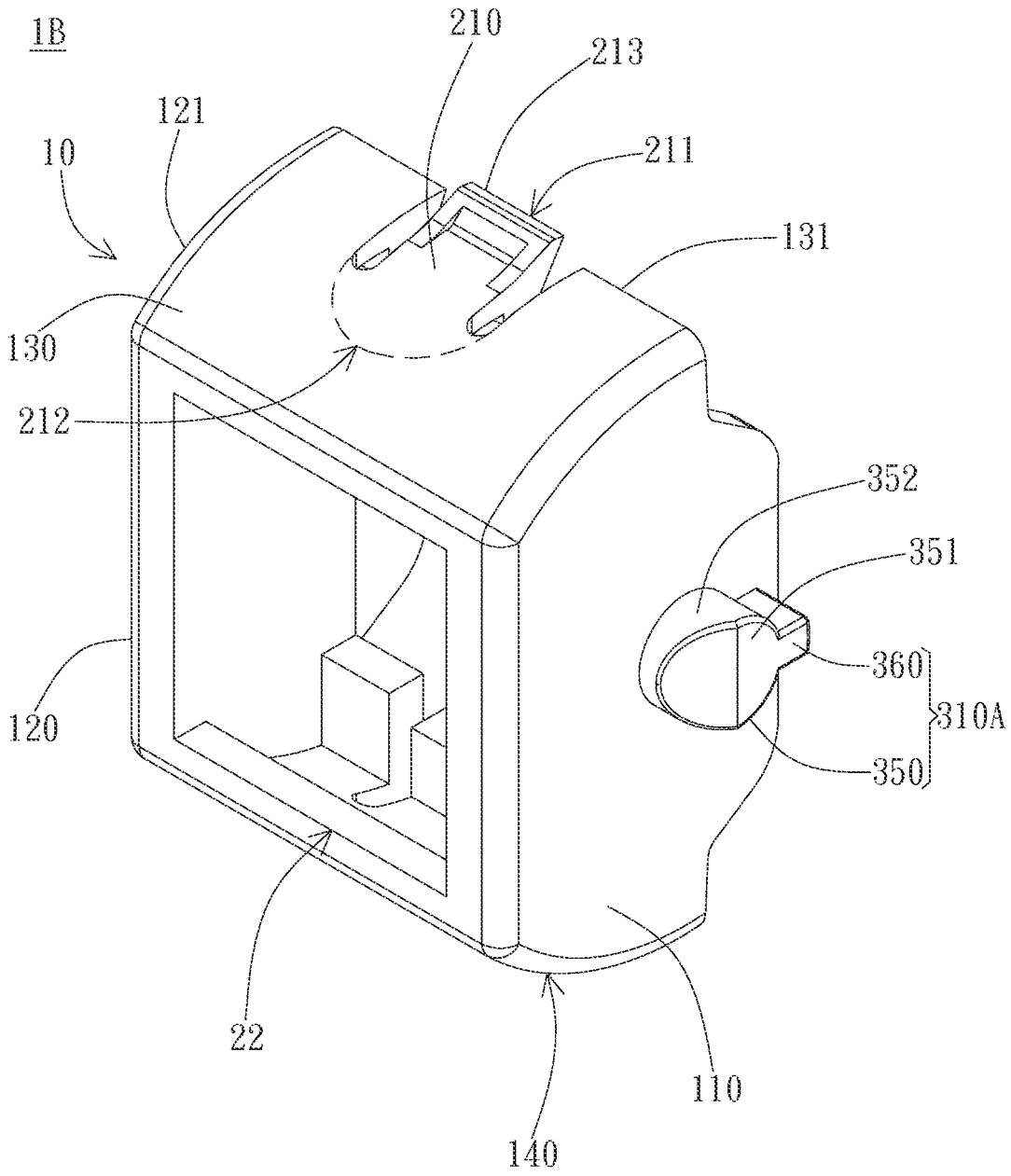
FIG. 2A is a schematic view of another embodiment of a rotatable frame of the present invention.
Figure 2B:
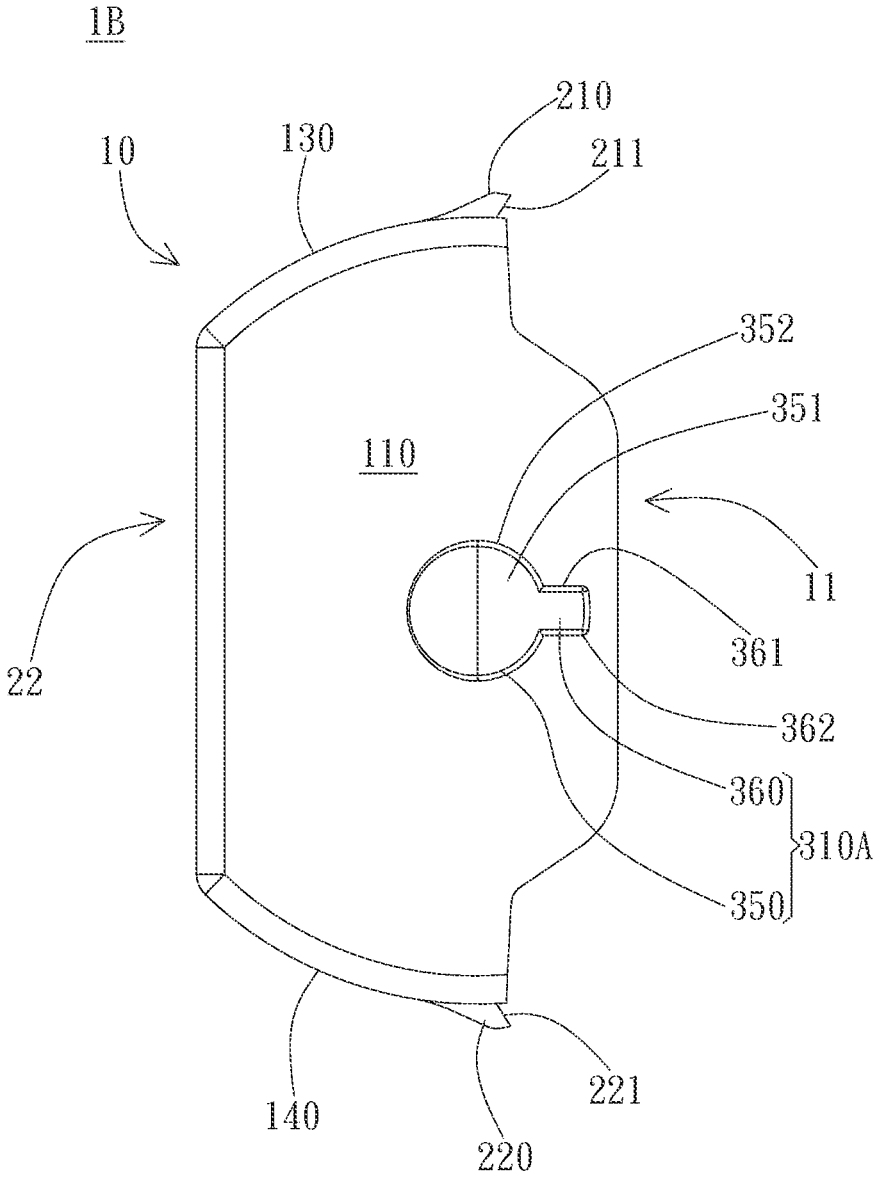
FIG. 2B is a side view of the embodiment of the rotatable frame of the present invention.

In addition, the present invention further provides another embodiment of the rotatable frame. Please refer to FIGS. 2A and 2B; FIG. 2A is a schematic view of another embodiment of a rotatable frame of the present invention; FIG. 2B is a side view of the embodiment of the rotatable frame of the present invention. As shown in FIG. 2A, compared to the rotatable frame 1A, a pivot 310A of a rotatable frame 1B includes a pivot post 350 and a blocking portion 360, wherein the pivot post 350 has a top surface 351 and a curved surface 352 surrounding the top surface 351. It is noted that the blocking portion 360 protrudes from the curved surface 352 toward the connector inserting opening 11. In addition, as shown in FIG. 2B, the blocking portion 360 has blocking side surfaces 361/362 on the opposing sides. In practical applications, the rotatable frame 1B utilizes the relative position of the positioning portions 210/220 as well as the blocking portion 360 to the plate (not shown) to position the connector.

Figure 3:
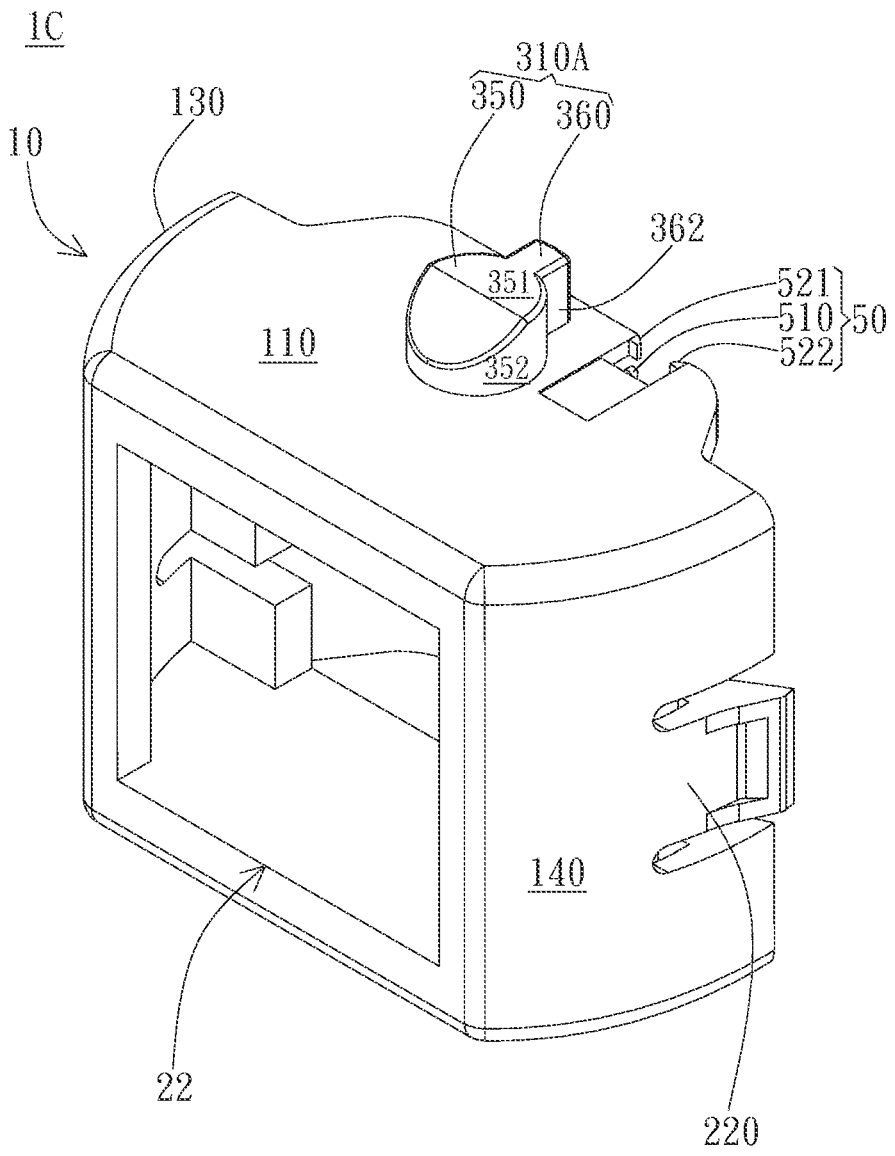
FIG. 3 is a schematic view of another embodiment of a rotatable frame of the present invention.

In addition, please refer to FIG. 3; FIG. 3 is a schematic view of another embodiment of a rotatable frame of the present invention. As shown in FIG. 3, compared to the rotatable frame 1B, a rotatable frame 1C further includes a ground connecting part 50 which is disposed on the frame body 10 in a recessed form and connects an external ground wire. It is noted that the ground connecting part 50 can also be employed to the rotatable frame 1A, but not limited to the embodiment. Moreover, the rotatable frame 1C is a conductive component and can provide the connector with excellent grounding or shielding effect. In the embodiment, the ground connecting part 50 is adjacent to the pivot 310A and is disposed on the first sidewall 110, but not limited to the embodiment. Particularly, the ground connecting part 50 of the rotatable frame 1C includes a ground terminal 510 and clamping portions 521/522, wherein the ground terminal 510 is used for electrically connecting the wire. In addition, the clamping portions 521/522 can clamp the wire to prevent the wire from coming off the rotatable frame 1C.

Figure 4A:
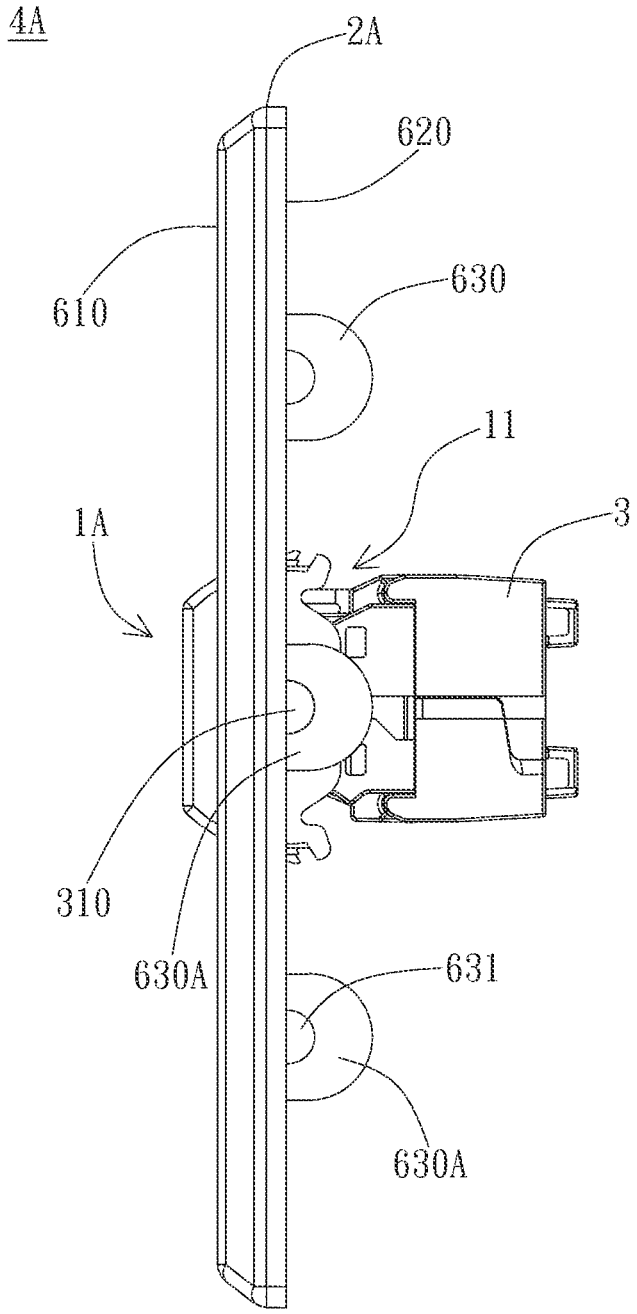
FIG. 4A is a side view of an embodiment of a connector support system.
Figure 4B:
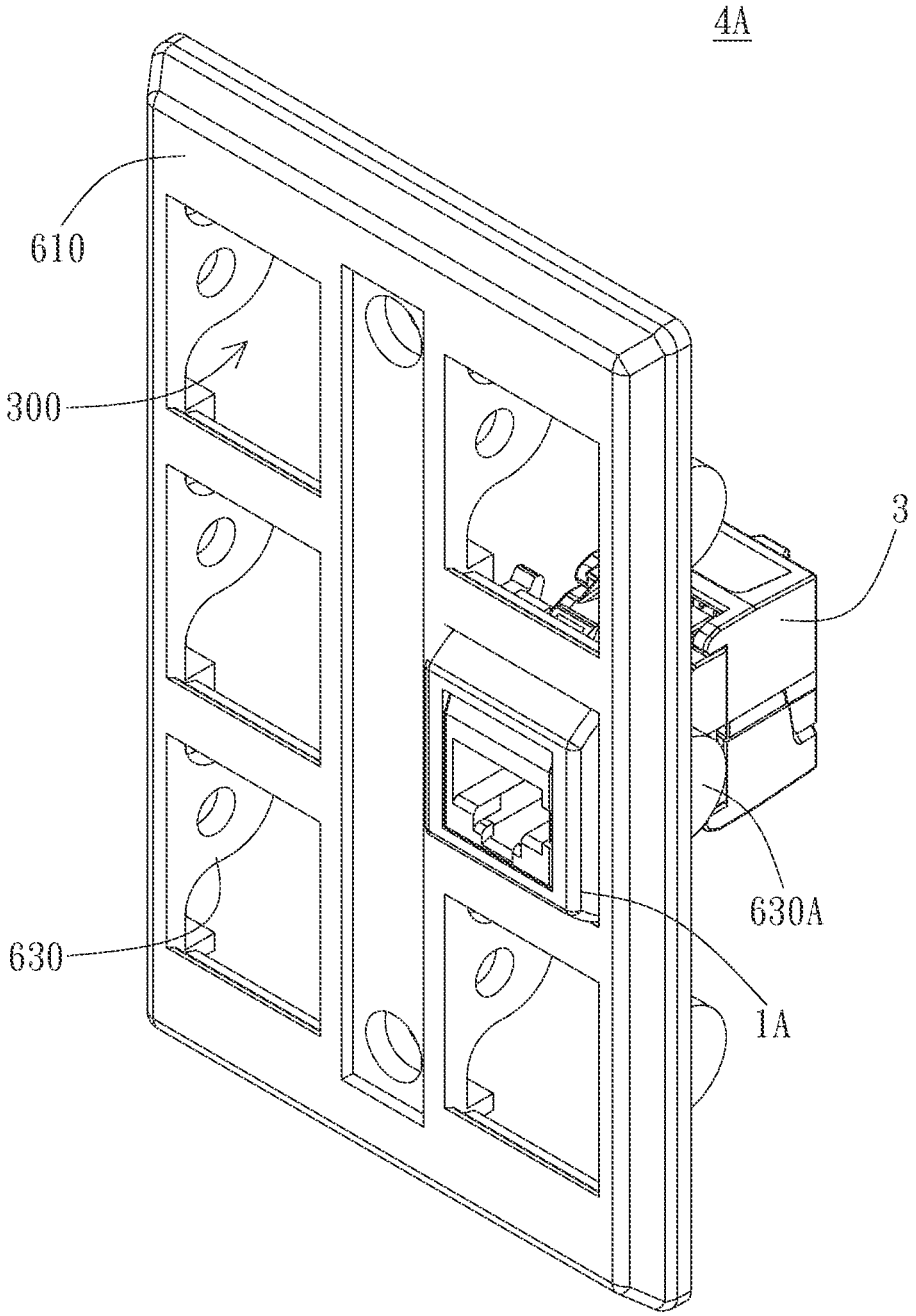
FIG. 4B is a schematic view of the embodiment of the connector support system of the present invention.
Figure 4C:
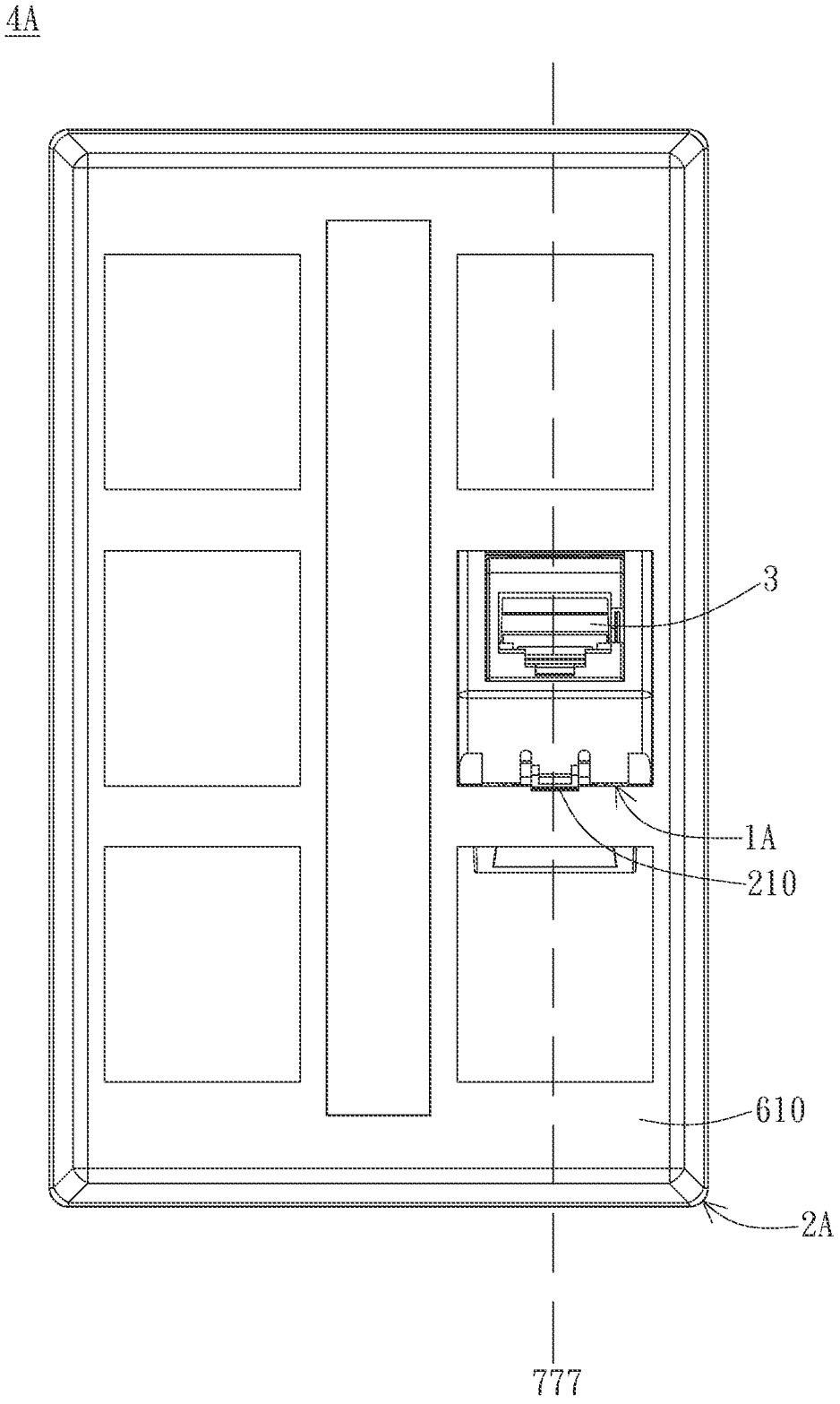
FIG. 4C is a front view of the embodiment of the connector support system of the present invention.
Figure 4D:
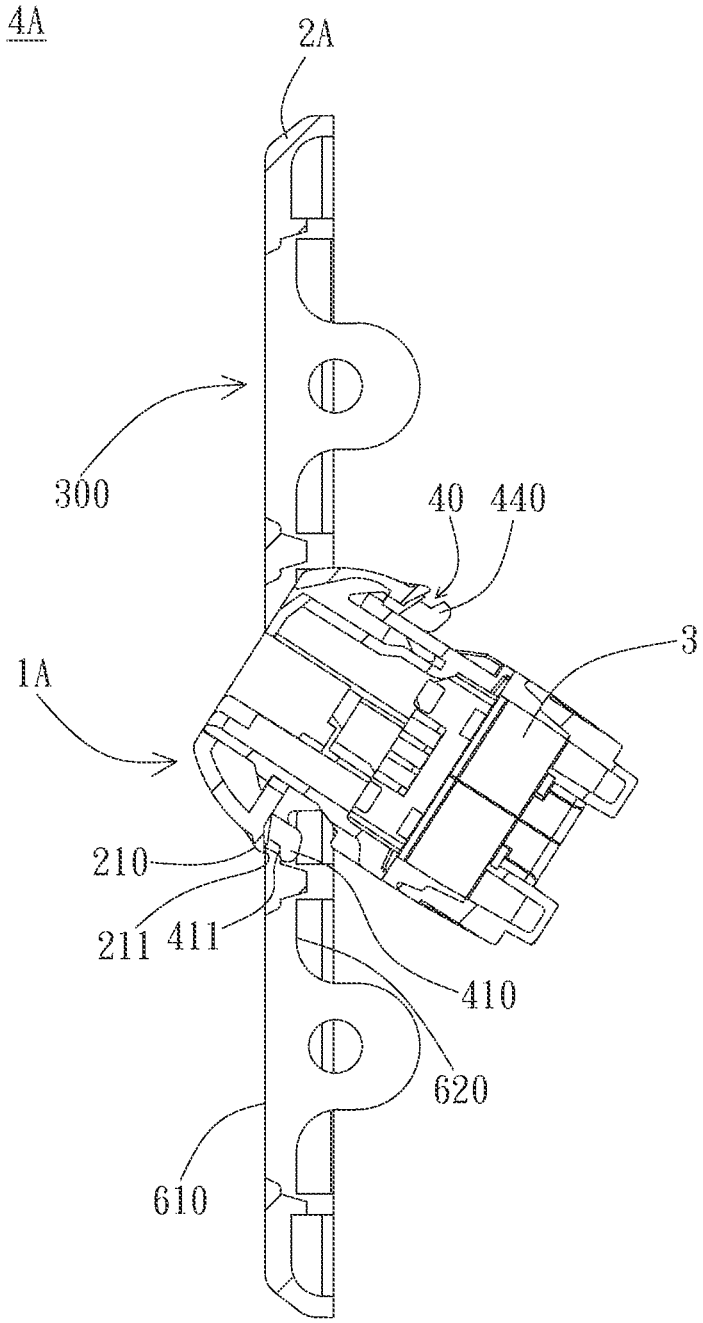
FIG. 4D is a sectional view along a sectional line of the connector support system of FIG. 4C.

According to another embodiment of the present invention, a connector support system is provided for accommodating a connector. Please refer to FIGS. 4A, 4B, 4C, and 4D; FIG. 4A is a side view of an embodiment of a connector support system; FIG. 4B is a schematic view of the embodiment of the connector support system of the present invention; FIG. 4C is a front view of the embodiment of the connector support system of the present invention; FIG. 4D is a sectional view along a sectional line 777 of the connector support system of FIG. 4C.

As shown in FIGS. 4A and 4D, the connector support system 4A includes a plate 2A and the rotatable frame 1A. As shown in FIGS. 4A and 4B, the plate 2A has an outer surface 610, an inner surface 620 opposite to the outer surface 610, and at least one ear part 630A, wherein the ear part 630A can be a plate-like unit and extend vertical to the inner surface 620. That is, the normal to the surface of the plate-like ear part 630 is perpendicular to the normal to the inner surface 620 of the plate 2A. In practical applications, the plate 2A can be disposed on a wall, a connecting panel of a device, or any suitable boards.

It is noted that, as shown in FIG. 4A, the ear part 630A has an axle hole 631. In addition, as shown in FIG. 4A, the connector 3 is inserted into the connector inserting opening 11 to be disposed on the rotatable frame 1A. As shown in FIG. 4A, in the embodiment, the pivot 310 is inserted into the axle hole 631, so that the rotatable frame 1A can rotate about the pivot 310 with respect to the plate 2A. In other words, the external diameter of the pivot 310 is equal to or less than the diameter of the axle hole 631, so that the pivot 310 can be rotatably disposed within the axle hole 631. Furthermore, as shown in FIG. 4B, the plate 2A includes at least one through hole 300, wherein the hole 300 is recessed from the outer surface 610, wherein the pivot 310 can rotatably engage with the ear part 630A to rotate the frame body 1A.

In practical applications, as shown in FIG. 4D, for instance, the blocking surface 211 of the positioning portion 210 selectively presses against the outer surface 610. In addition, as shown in FIGS. 4B and 4D, the engaging surface 411 of the protruding finger 410 presses against the inner surface 620 of the plate 2A. In such a configuration, the positioning portion 210 and the protruding finger 410 clamp the plate 2A, so that the plate 2A is disposed in the clamping gap 40. As shown in FIGS. 4D and 4C, the positioning portion 210 extends out of the hole 300, and the blocking surface 211 presses against the outer surface 610.

In other words, when the positioning portion 210 of the rotatable frame 1A extends from the inner surface 620 toward the outer surface 610, the positioning portion 210 and the protruding finger 410 respectively press against the outer surface 610 and the inner surface 620 to clamp the plate 2A. It is noted that the rotatable frame 1A accommodates the connector 3 to rotate together so as to adjust the opening orientation of the connector 3. As shown in FIG. 4D, after the connector 3 is rotated with the rotatable frame 1A and is engaged with the plate 2A, the connector 3 is obliquely disposed on the plate 2A, so that the connecting wire can obliquely extend from the connector 3. In practical applications, users can utilize the tool (such as screwdriver) to press the positioning portion 210, so that the positioning portion 210, as shown in the embodiment of FIG. 4A, retreats from the outer surface 610 toward the inner surface 620. Particularly, the connector support system 4A can enable the connector 3 to rotate and position the connector 3 on the plate 2A with an oblique orientation so as to provide the effect of connecting the wire in the oblique orientation as well as avoiding the wire to be damaged by the external force.

Figure 5A:
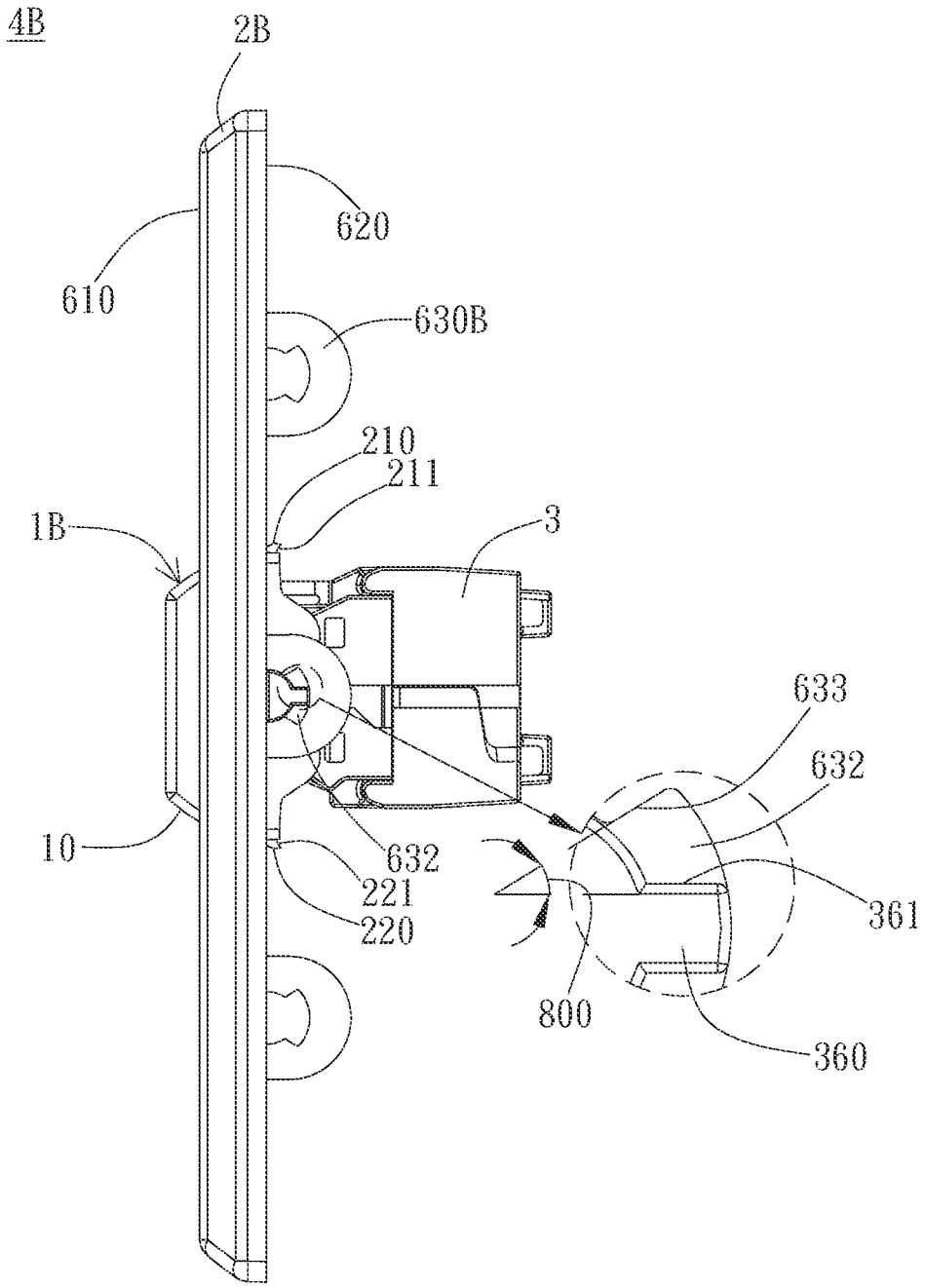
FIG. 5A is a side view of an embodiment of a connector support system of the present invention.
Figure 5B:
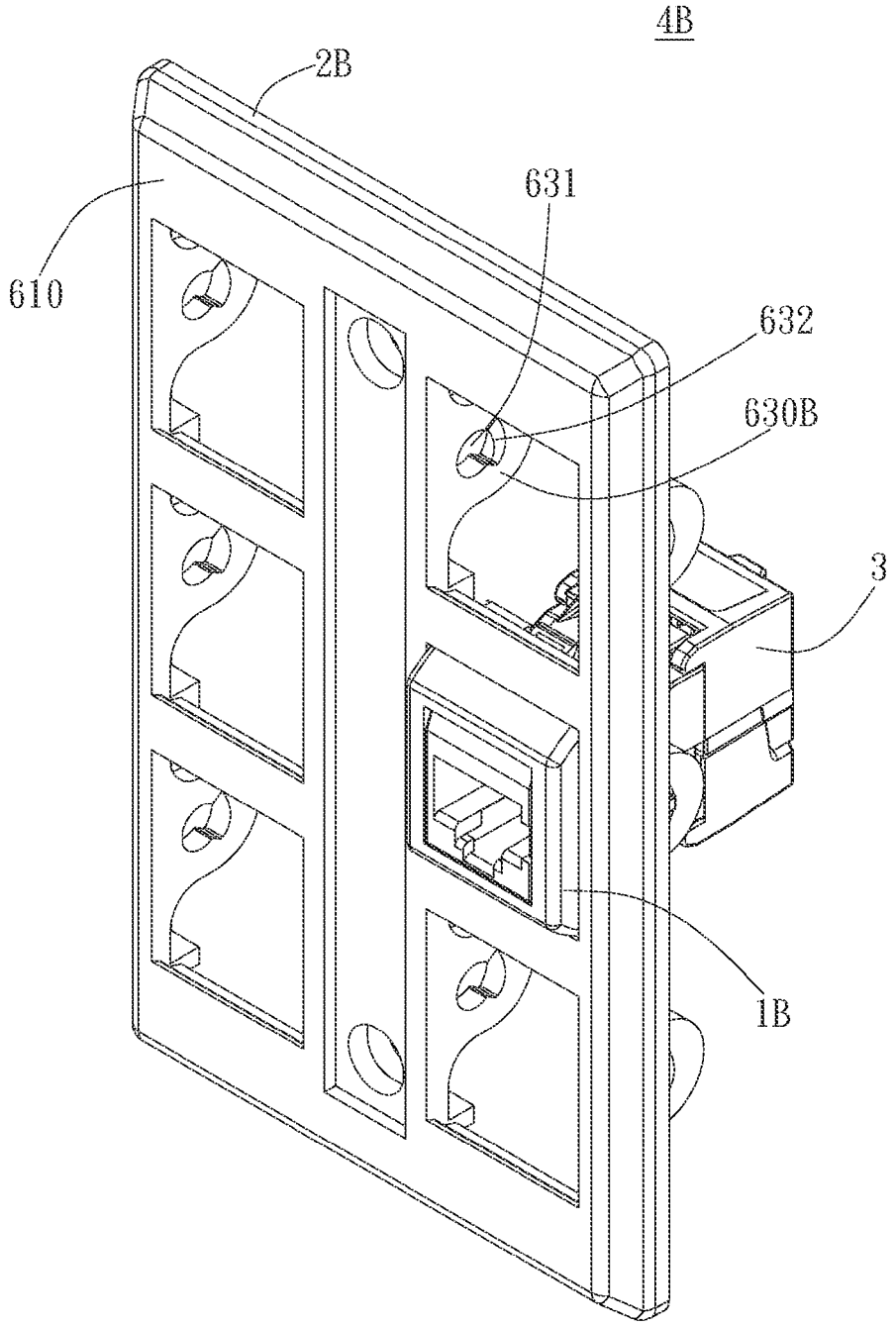
FIG. 5B is a schematic view of the embodiment of the connector support system of the present invention.
Figure 5C:
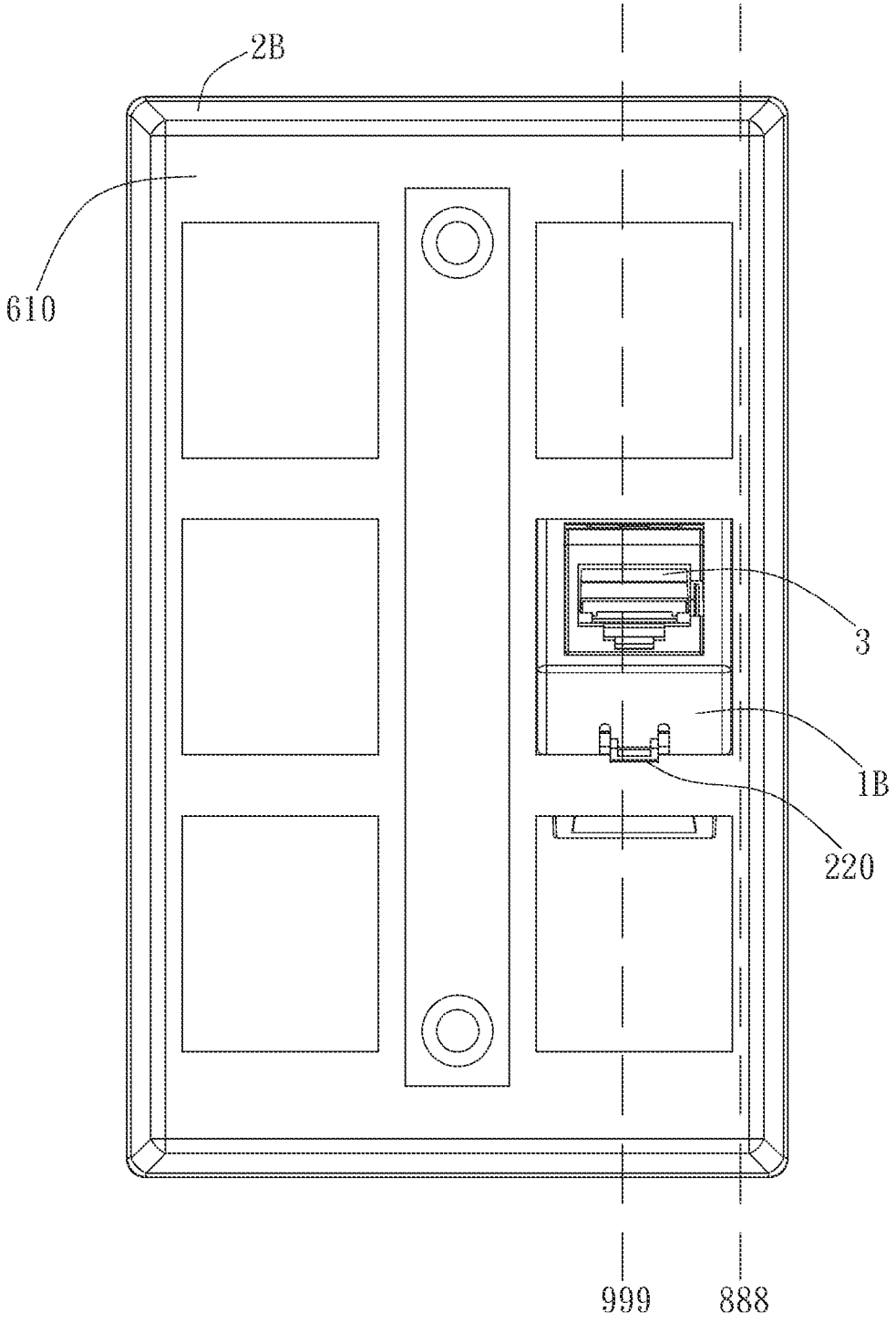
FIG. 5C is a front view of the embodiment of the connector support system of the present invention.
Figure 5D:
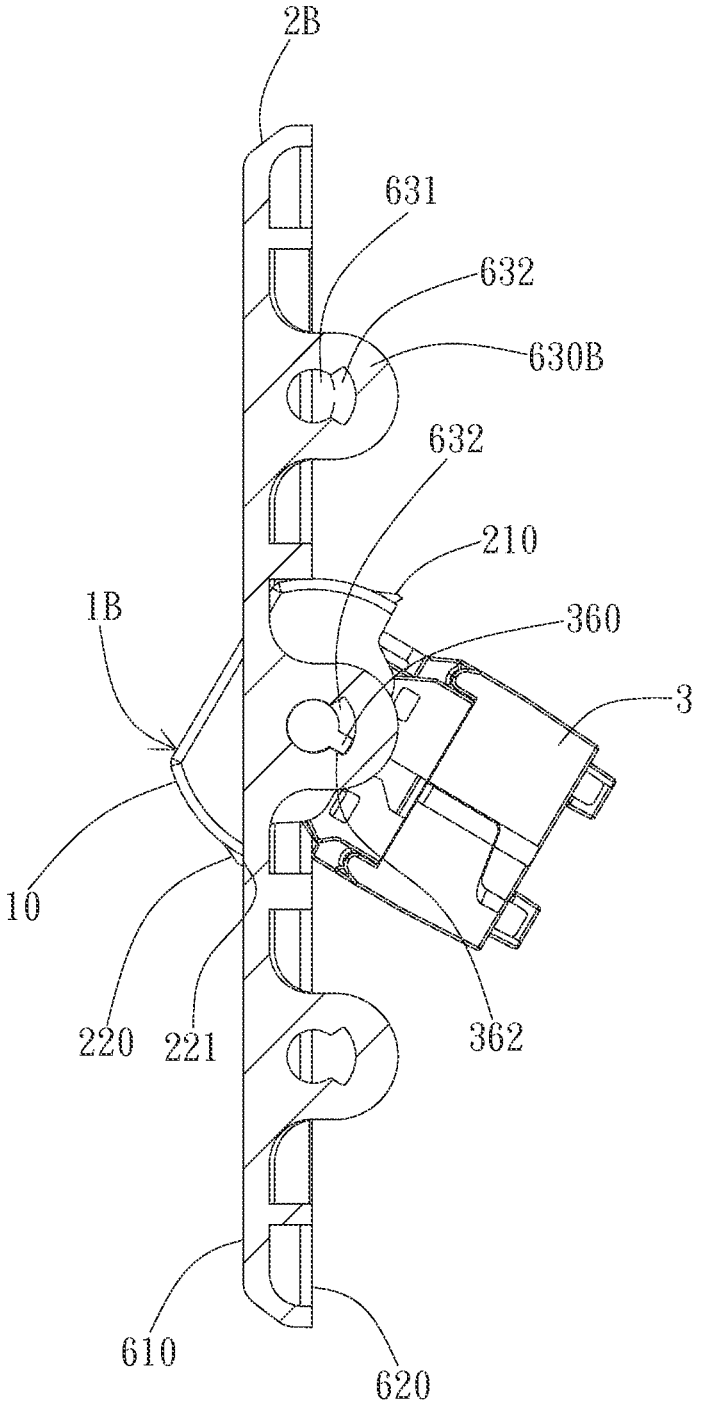
FIG. 5D is a sectional view along a sectional line of the connector support system of FIG. 5C.
Figure 5E:
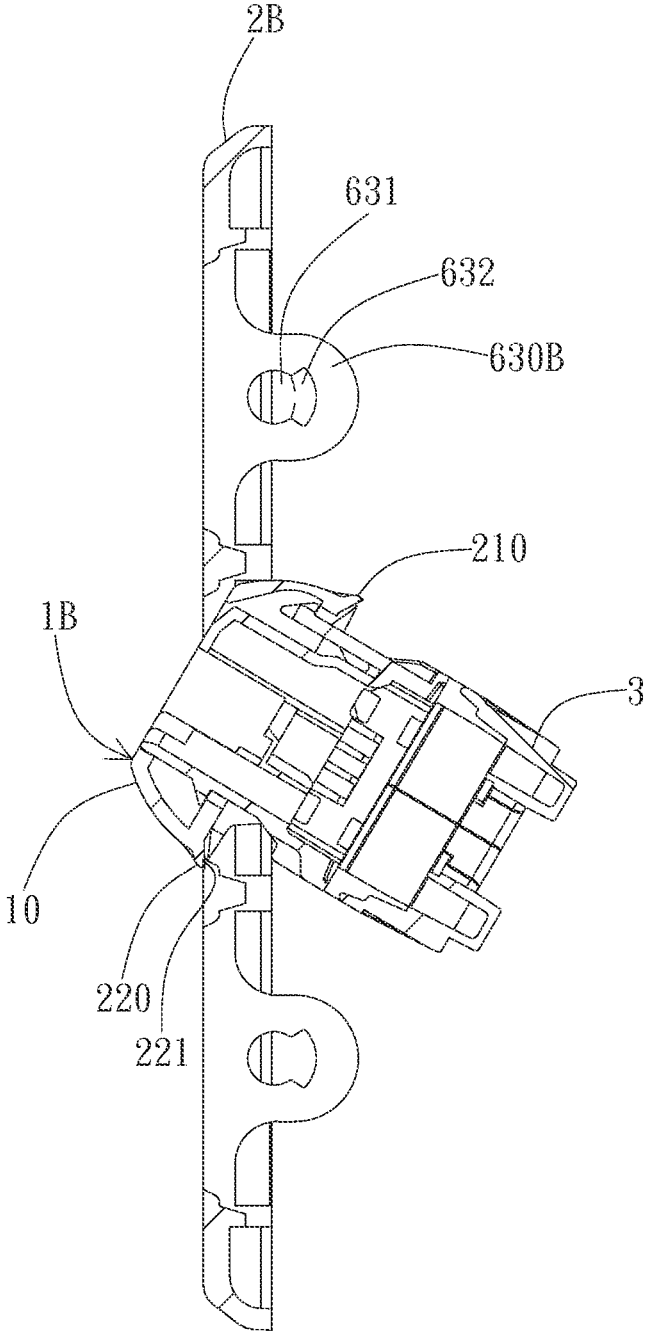
FIG. 5E is a sectional view along another sectional line of the connector support system of FIG. 5C

In addition, please refer to FIGS. 5A, 5B, 5C, 5D, and 5E; FIG. 5A is a side view of an embodiment of a connector support system of the present invention; FIG. 5B is a schematic view of the embodiment of the connector support system of the present invention; FIG. 5C is a front view of the embodiment of the connector support system of the present invention; FIG. 5D is a sectional view along a sectional line 888 of the connector support system of FIG. 5C; FIG. 5E is a sectional view along a sectional line 999 of the connector support system of FIG. 5C. As shown in FIG. 5A, the connector support system 4B includes the rotatable frame 1B and the plate 2B, wherein the rotatable frame 1B accommodates the connector 3. Particularly, the embodiment shown in FIGS. 5A and 5B shows an example of the un-rotated connector 3; the embodiment shown in FIGS. 5C, 5D, and 5E shows an example of the rotated connector 3.

As shown in FIGS. 5B and 5D, compared to the plate 2A of FIGS. 4A through 4D, the plate 2B includes at least one fan-shaped hole 632, wherein the fan-shaped hole 632 is disposed on the ear part 630B. In practical applications, the fan-shaped hole 632 communicates with the axle hole 631 and is disposed on a side of the ear part 630B that is away from the plate 2B. As shown in FIGS. 5A, 5D, and 5E, the blocking portion 360 swings in the fan-shaped hole 632. When the blocking side surface 361 or 362 contacts one side of the fan-shaped hole 632, one of the two positioning portions 210/220 (e.g. the positioning portion 220) and the blocking portion 360 fix the frame body 10 on the plate 2B. For instance, as shown in FIG. 5A, an angle 800 is included between the blocking side surface 361 and a side 633 of the fan-shaped hole 632, wherein the angle 800 is preferably the same as the angle 700, so that the connector 3 is disposed on the plate 2B in the oblique orientation. In other words, the angle 800 is the largest rotating angle of the connector 3; in the embodiment, the angle 800 is 30 degrees, but not limited to the embodiment.

Particularly, the embodiment of FIGS. 5A through 5E utilizes the rotatable frame 1B to rotate the connector 3 and utilizes the positioning portions 210/220 and the blocking side surface 361 of the blocking portion 360 to position the connector 3 on the plate 2B. It is noted that, because the rotatable frame 1B has the blocking portion 360, the rotatable frame 1B is preferably disposed on the plate 2B, instead of the plate 2A of FIGS. 4A through 4D. However, if the angle 800 of FIG. 5A is larger than or equal to the angle 700 of FIG. 1B, the rotatable frame 1A can be disposed on the plate 2A or the plate 2B, but not limited thereto.

Figure 6A:
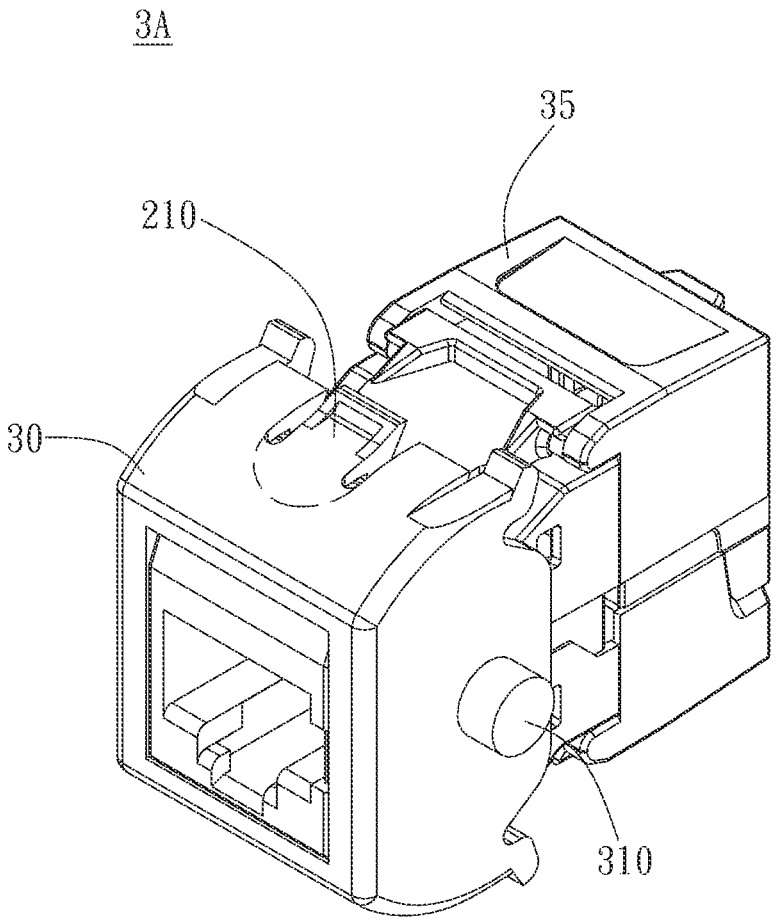
FIG. 6A is a schematic view of an embodiment of a connector of the present invention.

In addition, according to another embodiment of the present invention, a connector is provided on a plate. Please refer to FIG. 6A; FIG. 6A is a schematic view of an embodiment of a connector of the present invention. As shown in FIG. 6A, the connector 3A includes a connector body 35, a frame body 30, two positioning portions 210/220 (not shown), and two pivots 310. Particularly, the connector body 35 is the connector 3 of FIG. 4A. The frame body 30, the two positioning portions 210/220, and the two pivots 310/(not shown) are similar to the components of the rotatable frame 1A of FIG. 1A, wherein the frame body 30 equals the frame body 10. In other words, the connector body 35 and the structure of the rotatable frame 1A of FIG. 1A are integrated to form the connector 3A, so that the connector 3A itself has the functions of electrically-connecting and rotating. In practical applications, users can directly arrange the connector 3A on the plate to enable the rotation of the connector 3A without using additional rotatable structures.

Figure 6B:
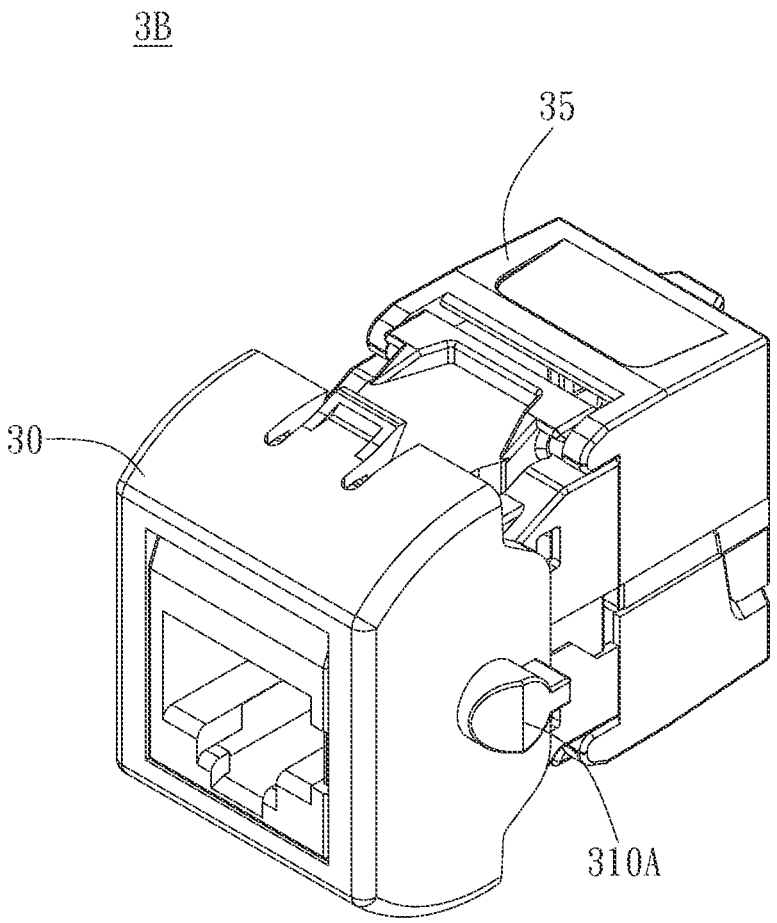
FIG. 6B is a schematic view of another embodiment of a connector of the present invention.

Please refer to FIG. 6B; FIG. 6B is a schematic view of another embodiment of a connector of the present invention. As shown in FIG. 6B, the connector 3B includes the connector body 35, the frame body 30, the two positioning portions 210/220 (not shown), and two pivots 310A. Particularly, the connector body 35 is the connector 3 of FIG. 4A. The frame body 30, the two positioning portions 210/220, and the two pivots 310A/(not shown) are similar to the components of the rotatable frame 1B of FIG. 2A, wherein the frame body 30 equals the frame body 10. In other words, the connector body 35 and the structure of the rotatable frame 1B of FIG. 2A are integrated to form the connector 3B, so that the connector 3B itself has the functions of electrically-connecting and rotating. In practical applications, users can directly arrange the connector 3B on the plate to enable the rotation of the connector 3B without using additional rotatable structures.

Figure 7:
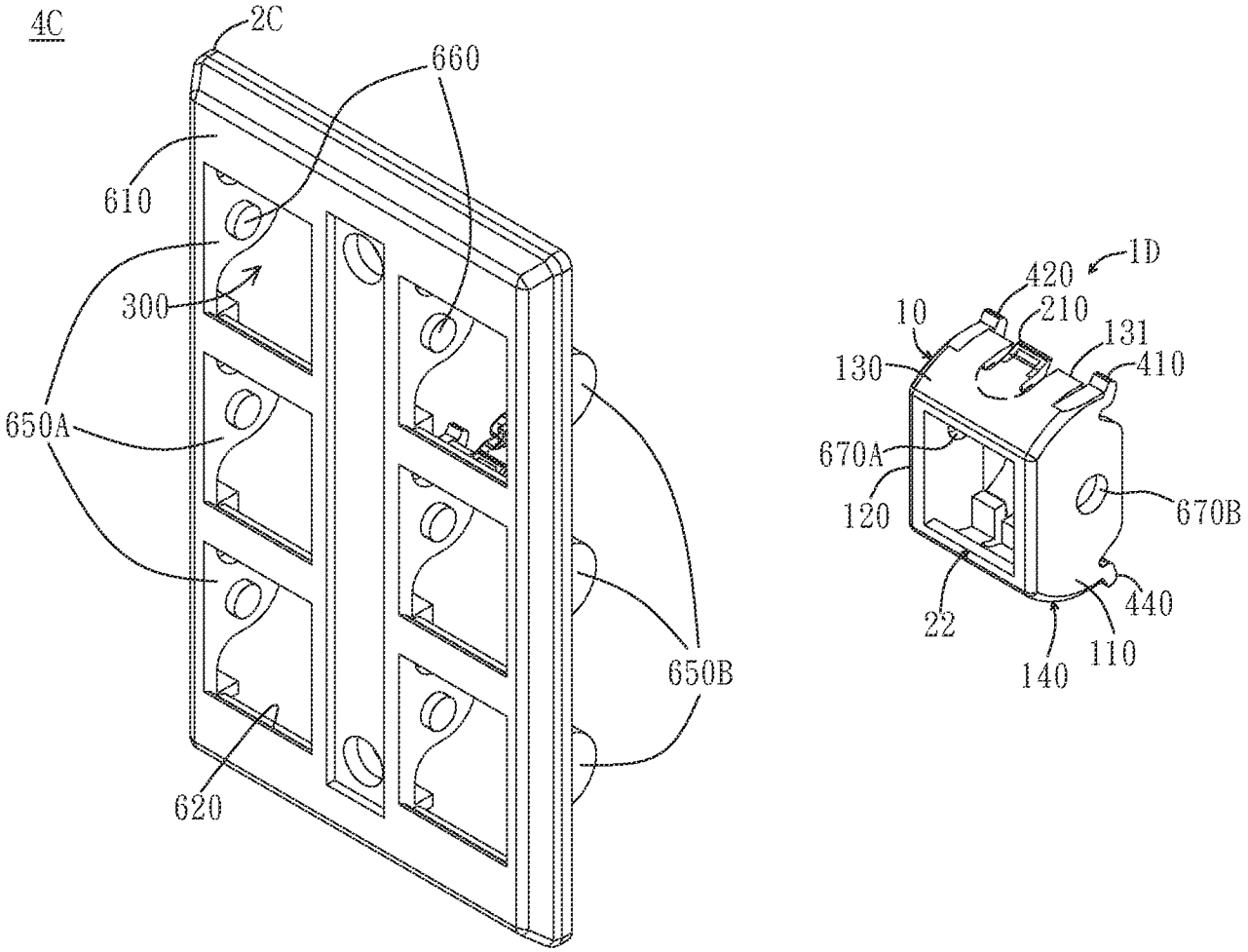
FIG. 7 is a schematic view of another embodiment of a connector support system of the present invention.

Please refer to FIG. 7; FIG. 7 is a schematic view of another embodiment of a connector support system of the present invention. As shown in FIG. 7, the connector support system 4C includes a plate 2C and a rotatable frame 1D. It is noted that the plate 2C includes a first ear part 650A, a second ear part 650B, and two pivots 660, wherein the first ear part 650A and the second ear part 650B are a plate-like unit and respectively extend vertical to the inner surface 620 of the plate 2C. It is noted that the shape of the first ear part 650A and the second ear part 650B can be the same.

In addition, the pivots 660 respectively protrude from the first ear part 650A and the second ear part 650B coaxially. In the embodiment, the first sidewall 110 and the second sidewall 120 of the rotatable frame respectively have a first axle hole 670A and a second axle hole 670B. The two pivots 660 are respectively inserted into the first axle hole 670A and the second axle hole 670B, so that the rotatable frame 1D rotates about the two pivots 660 with respect to the plate 2C. In practical applications, the pivots 660 of the rotatable frame 1D are disposed on the plate 2C, and the first axle hole 670A and the second axle hole 670B are disposed in the rotatable frame 1D, so that the connector support system 4C can provide the effect of rotating the connector.

Figure 8A:
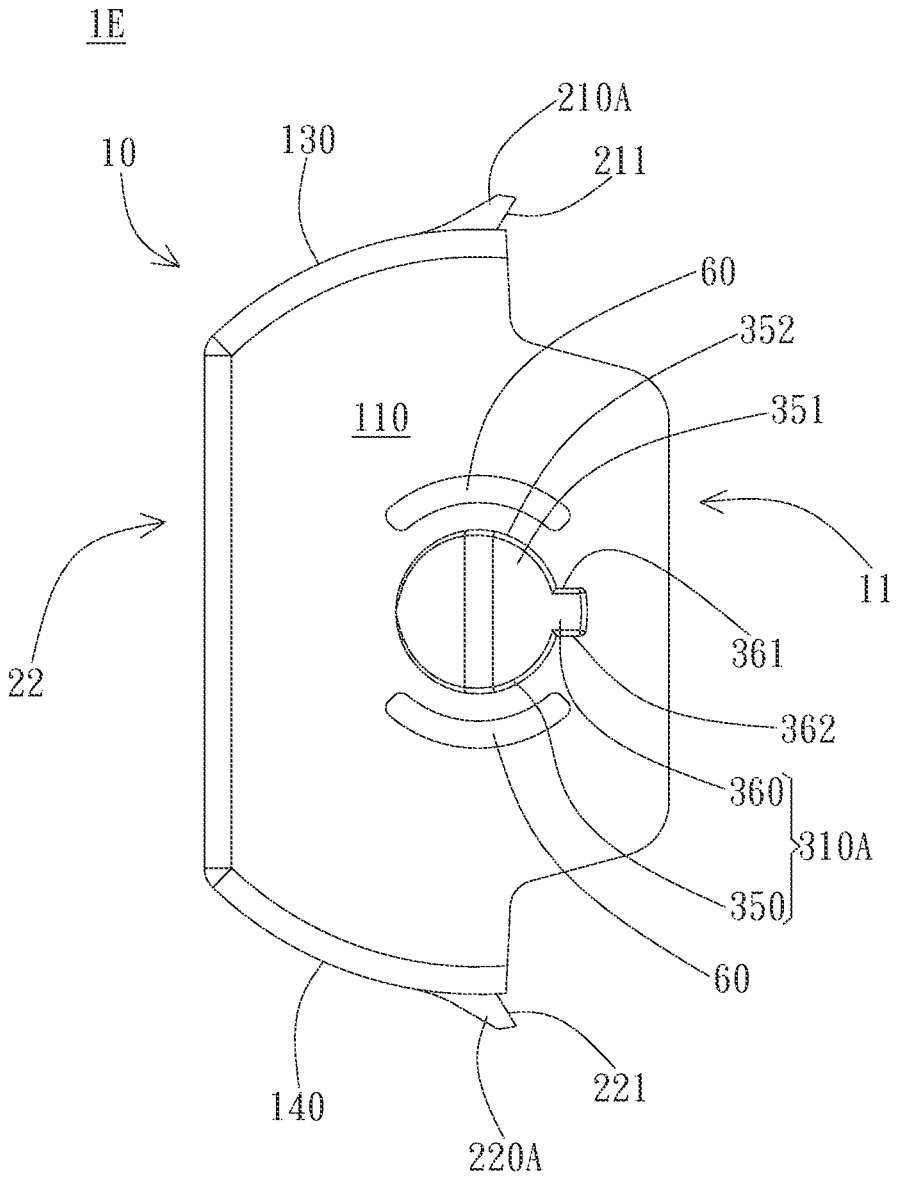
FIG. 8A is a side view of an embodiment of a rotatable frame of the present invention.
Figure 8B:
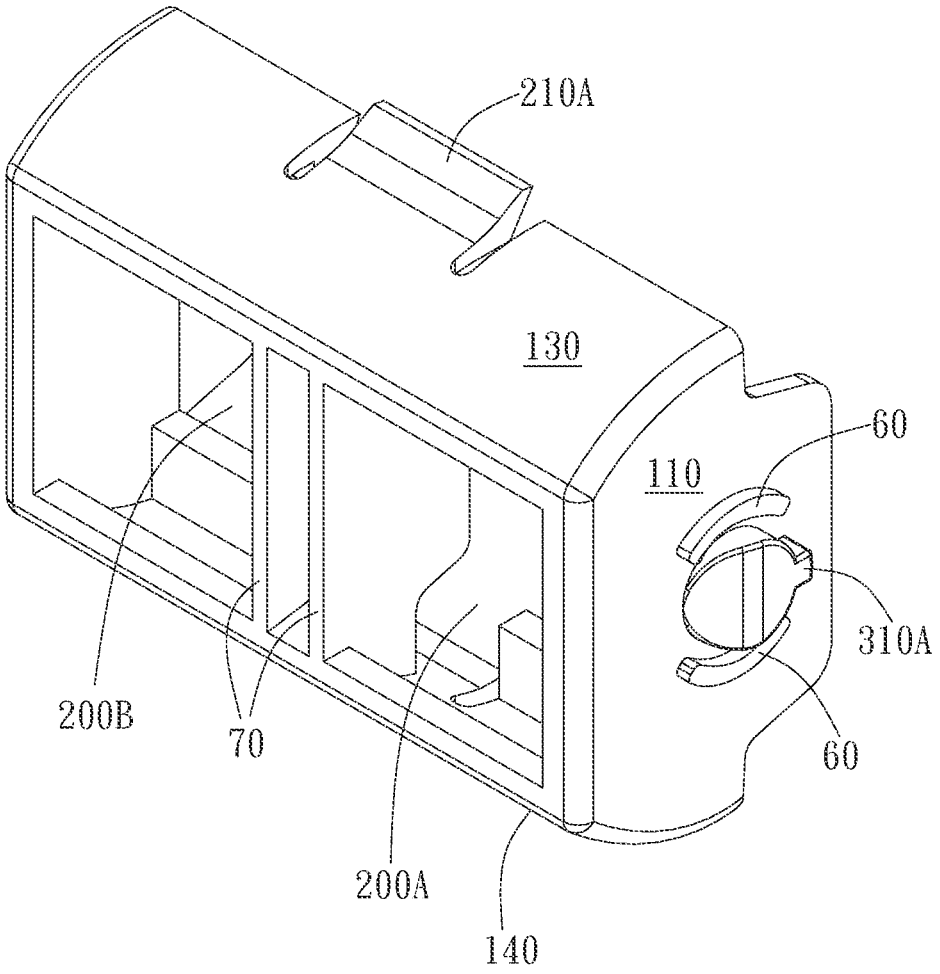
FIG. 8B is a schematic view of the embodiment of the rotatable frame of the present invention.
Figure 8C:
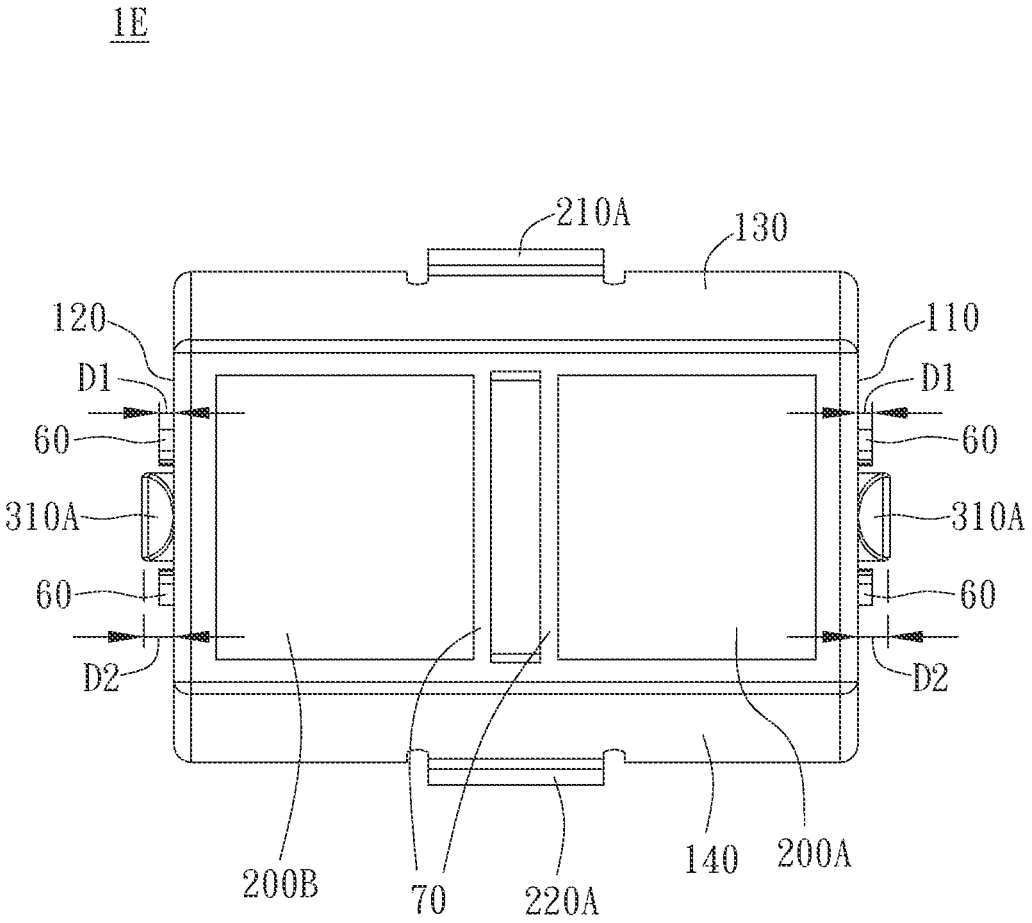
FIG. 8C is a front view of the embodiment of the rotatable frame of the present invention.

In addition, the present invention further provides another rotatable frame to avoid the wear and tear. Please refer to FIGS. 8A, 8B, and 8C; FIG. 8A is a side view of an embodiment of a rotatable frame of the present invention; FIG. 8B is a schematic view of the embodiment of the rotatable frame of the present invention; FIG. 8C is a front view of the embodiment of the rotatable frame of the present invention.

As shown in FIGS. 8A through 8C, a rotatable frame 1E includes a plurality of wall structures 60 and at least one partition 70. In practical applications, the wall structures 60 are respectively disposed on the first sidewall 110 and the second sidewall 120 and surround the outer edge of the pivot 310A. It is noted that the wall structure 60 has less thickness D1 on the first sidewall 110 or the second sidewall 120 than the thickness D2 of the two pivots 310A. In other words, the wall structures 60 can directly contact the surface of the plate to avoid the first sidewall 110 and the second sidewall 120 directly contacting the plate so as to decrease the rubbing of the first sidewall 110 and the second sidewall 120 against the plate. In practical applications, the wall structures 60 can prevent the first sidewall 110 and the second sidewall 120 from rubbing over a long period of time that causes damages, so that the service life of the rotatable frame 1E can be increased.

In the embodiment, the wall structure 60 is an arc-shaped structure and is bent to extend along the outer edge of the pivot 310A, but not limited to the embodiment. Particularly, the bending degree of the wall structure 60 is determined by the shape or curvature of the curved surface 352 of the pivot 310A so as to further provide a fixed rotation trace. In other embodiments, the shape of the wall structure 60 can be a squared shape, a circular shape, or other geometric shapes, but not limited thereto.

In addition, as shown in FIGS. 8B and 8C, the partition 70 is vertically connected with the top plate 130 and the bottom plate 140 to divide the accommodation space. In the embodiment, the partition 70 divides the accommodation space into the accommodation space 200A and the accommodation space 200B, and the partition 70 is parallel to the first sidewall 110 and the second sidewall 120. It is noted that the size of the accommodation space 200A and the accommodation space 200B can be the same as the accommodation space 200 of FIG. 1C. In other words, the rotatable frame 1E can accommodate two connectors and is a multi-opening frame, for example having two connector inserting openings in this embodiment. It is noted that, in other embodiments, the rotatable frame can involve more partitions and extend the length of the top plate 130 and the bottom plate 140 so as to accommodate more connectors.

Compared to prior arts, the rotatable frame of the present invention engages the connector on the frame body and utilizes the pivot to enable the rotation of the connector, and the blocking surface of the positioning portion presses against the plate so as to fix the rotated connector on the plate. In practical applications, the present invention further provides a connector which has the rotating function and can be directly disposed on the plate. It is noted that, according to an embodiment of the present invention, the plate of the connector support system has an ear part, and the rotatable frame can be rotatably connected with the ear part so as to rotate the connector.

What is claimed is:

1. A rotatable frame used with a plate for accommodating a connector, comprising:

a frame body having a first sidewall, a second sidewall, a top plate, and a bottom plate, wherein the first sidewall, the second sidewall, the top plate, and the bottom plate are connected to enclose an accommodation space for accommodating the connector and to form a connector inserting opening;

two positioning portions respectively formed on the top plate and the bottom plate at a first side near the connector inserting opening, the two positioning portions respectively having a blocking surface, wherein the blocking surface obliquely extends away from the connector inserting opening; and two pivots respectively protruding from an outer side of the first sidewall and an outer side of the second sidewall coaxially;

wherein the first sidewall and the second sidewall respectively comprises at least one protruding finger respectively extending from an edge of the first sidewall and an edge of the second sidewall near the connector inserting opening and crooking to form an engaging surface, wherein the engaging surface is parallel to the blocking surface and has a clamping gap with the blocking surface.

2. The rotatable frame of claim 1, wherein the top plate and the bottom plate are respectively a U-shaped plate, the two positioning portions respectively extend from a recession of the U-shaped plate toward an opening of the U-shaped plate and respectively have a connecting end and a free end, the connecting ends of the two positioning portions are respectively connected to the top plate and the bottom plate, the free end expands to form the blocking surface.

3. The rotatable frame of claim 1, wherein the two pivots comprise:

a pivot post having a top surface and a curved surface surrounding the top surface; and a blocking portion protruding from the curved surface toward the connector inserting opening and having a blocking side surface.

4. The rotatable frame of claim 1, wherein sides of the first sidewall and the second sidewall connected to the bottom plate and the top plate have a curved shape, and the top plate and the bottom plate curvedly connect the first sidewall and the second sidewall.

5. The rotatable frame of claim 1, further comprising:

a ground connecting part disposed on the frame body and connecting a ground wire.

6. The rotatable frame of claim 1, further comprising:

a plurality of wall structures respectively disposed on the first sidewall and the second sidewall and surrounding outer edges of the two pivots, wherein the wall structure has less thickness on the first sidewall or the second sidewall than on the two pivots.

7. The rotatable frame of claim 1, further comprising:

at least one partition vertically connected with the top plate and the bottom plate to divide the accommodation space, wherein the at least one partition is parallel to the first sidewall and the second sidewall.

8. A connector used on a plate, comprising:

a connector body;

a frame body having a first sidewall, a second sidewall, a top plate, and a bottom plate, wherein the first sidewall, the second sidewall, the top plate, and the bottom plate are connected to enclose an accommodation space for accommodating the connector body and to form a connector inserting opening;

two positioning portions respectively formed on the top plate and the bottom plate at a first side near the connector inserting opening, the two positioning portions respectively having a blocking surface, wherein the blocking surface obliquely extends away from the connector inserting opening; and two pivots respectively protruding from an outer side of the first sidewall and an outer side of the second sidewall coaxially;

wherein the first sidewall and the second sidewall respectively comprises at least one protruding finger respectively extending from an edge of the first sidewall and an edge of the second sidewall near the connector inserting opening and crooking to form an engaging surface, wherein the engaging surface is parallel to the blocking surface and has a clamping gap with the blocking surface.

9. The connector of claim 8, wherein the top plate and the bottom plate are respectively a U-shaped plate, the two positioning portions respectively extend from a recession of the U-shaped plate toward an opening of the U-shaped plate and respectively have a connecting end and a free end, the connecting ends of the two positioning portions are respectively connected to the top plate and the bottom plate, the free end expands to form the blocking surface.

10. The connector of claim 8, wherein the two pivots comprise:

a pivot post having a top surface and a curved surface surrounding the top surface; and a blocking portion protruding from the curved surface toward the connector inserting opening and having a blocking side surface.

11. The connector of claim 8, wherein sides of the first sidewall and the second sidewall connected to the bottom plate and the top plate have a curved shape, and the top plate and the bottom plate curvedly connect the first sidewall and the second sidewall.

12. The connector of claim 8, further comprising:

a ground connecting part disposed on the frame body and connecting a ground wire.

13. The connector of claim 8, further comprising:

a plurality of wall structures respectively disposed on the first sidewall and the second sidewall and surrounding outer edges of the two pivots, wherein the wall structure has less thickness on the first sidewall or the second sidewall than on the two pivots.

14. The connector of claim 8, further comprising:

at least one partition vertically connected with the top plate and the bottom plate to divide the accommodation space, wherein the at least one partition is parallel to the first sidewall and the second sidewall.

15. A connector support system for accommodating a connector, comprising:

a plate having an outer surface, an inner surface opposite to the outer surface, and at least one ear part, wherein the at least one ear part extends vertical to the inner surface; and a rotatable frame comprising:

a frame body having a first sidewall, a second sidewall, a top plate, and a bottom plate, wherein the first sidewall, the second sidewall, the top plate, and the bottom plate are connected to enclose an accommodation space for accommodating the connector and to form a connector inserting opening;

two positioning portions respectively formed on the top plate and the bottom plate at a first side near the connector inserting opening, the two positioning portions respectively having a blocking surface, wherein the blocking surface obliquely extends away from the connector inserting opening and selectively presses against the outer surface; and two pivots respectively protruding from an outer side of the first sidewall and an outer side of the second sidewall coaxially and extending into the at least one ear part, so that the rotatable frame rotates about the two pivots with respect to the plate;

wherein the first sidewall and the second sidewall respectively comprises at least one protruding finger respectively extending from an edge of the first sidewall and the second sidewall near the connector inserting opening and crooking to form an engaging surface, wherein the engaging surface is parallel to the blocking surface and has a clamping gap with the blocking surface, the engaging surface presses against the inner surface of the plate, and the two positioning portions and the at least one protruding finger clamp the plate, so that the plate is disposed in the clamping gap.

16. The connector support system of claim 15, wherein the top plate and the bottom plate are respectively a U-shaped plate, the two positioning portions respectively extend from a recession of the U-shaped plate toward an opening of the U-shaped plate and respectively have a connecting end and a free end, the connecting ends of the two positioning portions are respectively connected to the top plate and the bottom plate, the free end expands to form the blocking surface.

17. The connector support system of claim 15, wherein the two pivots comprise:

a pivot post having a top surface and a curved surface surrounding the top surface; and a blocking portion protruding from the curved surface toward the connector inserting opening and having a blocking side surface.

18. The connector support system of claim 15, wherein sides of the first sidewall and the second sidewall connected to the bottom plate and the top plate has a curved shape, and the top plate and the bottom plate curvedly connect the first sidewall and the second sidewall.

19. The connector support system of claim 15, wherein the plate comprises:

at least one hole recessed from the outer surface, wherein when the two pivots respectively pass through the at least one ear part to rotate the frame body, the at least one positioning portion extends out of the at least one hole, and the blocking surface presses against the outer surface.

20. The connector support system of claim 17, wherein the plate comprises:

at least one fan-shaped hole respectively disposed on the at least one ear part, wherein the blocking portion swings in the at least one fan-shaped hole; when the blocking side surface contacts a side of the fan-shaped hole, one of the two positioning portions and the blocking portion fix the frame body on the plate.

21. The connector support system of claim 15, wherein the rotatable frame further comprises:

a ground connecting part disposed on the frame body and connecting a ground wire.

22. The connector support system of claim 15, wherein the rotatable frame further comprises:

a plurality of wall structures respectively disposed on the first sidewall and the second sidewall and surrounding an outer edge of the two pivots, wherein the wall structure has less thickness on the first sidewall or the second sidewall than on the two pivots.

23. The connector support system of claim 15, wherein the rotatable frame further comprises:

at least one partition vertically connected with the top plate and the bottom plate to divide the accommodation space, wherein the at least one partition is parallel to the first sidewall and the second sidewall.

* * * * *